US005828384A

United States Patent [19]

Iwasaki et al.

[11] Patent Number: 5,828,384

[45] Date of Patent: Oct. 27, 1998

[54] IMAGE DISPLAY CONTROL DEVICE, METHOD AND COMPUTER PROGRAM PRODUCT

[75] Inventors: Keiichi Iwasaki, Yokohama; Toshihiro Tsukagoshi, Itami, both of Japan

[73] Assignee: Ricoh Company, Ltd., Tokyo, Japan

[21] Appl. No.: 711,870

[22] Filed: Sep. 12, 1996

[30] Foreign Application Priority Data

Sep. 14, 1995 [JP] Japan ..... 7-237280

[51] Int. Cl.[6] ..... G09G 5/00

[52] U.S. Cl. ..... 345/508; 345/203

[58] Field of Search ..... 345/508, 203, 345/196; 395/343, 344

[56] References Cited

U.S. PATENT DOCUMENTS

| | | | |
|---|---|---|---|
| 4,635,048 | 1/1987 | Nishi et al. | 345/203 |
| 5,043,714 | 8/1991 | Perlman | 345/196 |
| 5,251,298 | 10/1993 | Nally | 345/203 |
| 5,257,348 | 10/1993 | Roskowski et al. | 395/343 |
| 5,412,775 | 5/1995 | Maeda et al. | 345/199 |
| 5,416,497 | 5/1995 | Nishi et al. | 345/122 |
| 5,430,838 | 7/1995 | Kuno et al. | 345/119 |
| 5,436,641 | 7/1995 | Hoang et al. | 345/201 |
| 5,530,797 | 6/1996 | Uya et al. | 395/344 |
| 5,543,824 | 8/1996 | Priem et al. | 345/201 |

FOREIGN PATENT DOCUMENTS 60-241126 11/1985 Japan ..... G06F 3/14

*Primary Examiner*—Richard A. Hjerpe
*Assistant Examiner*—Ricardo Osorio
*Attorney, Agent, or Firm*—Cooper & Dunham LLP

[57] ABSTRACT

A VRAM stores a plurality of patterns of image data, an offset register stores values which indicate definition starting positions from which display image data are defined from the plurality of patterns of image data, respectively, a horizontal counter counts dots in a horizontal scanning direction, and a vertical counter counts lines in vertical scanning direction. Address and control signals are successively provided for reading a respective line of the display image data from the VRAM within one horizontal scanning period, based on the values of the offset register and the value of the vertical counter. Each of two second storage devices has a storage capacity for storing a thus-read respective line of the image data. Thus-read image data is written at addresses of a predetermined one of the two second storage devices, the addresses corresponding to displaying dots of the image data, while, according to the value of the horizontal counter, image data stored in the other one of the two second storage devices is read out, where, the image data writing and reading operations are performed alternately between the two second storage devices for each horizontal scanning period.

6 Claims, 12 Drawing Sheets

IMAGE DISPLAY CONTROL DEVICE, METHOD AND COMPUTER PROGRAM PRODUCT

BACKGROUND OF THE INVENTION

1. Field of the Invention

The present invention relates to an image display control device which is used, for example, in an apparatus such as a personal computer, a video game machine, and so forth in which various image display controls such as screen image scrolling are used.

2. Description of the Related Art

FIG. 1 shows a block diagram of an example of a basic configuration of an image display control device in the related art. An screen image is stored in an image data memory 54 in an area which is larger than a predetermined display screen area. An address generating circuit 53 receives count values from a horizontal counter 51 and a vertical counter 52, and generates an address for the image data memory 54. Thus, the count values of the two counters 51 and 52 are used for determine a scanning position in the display screen, and for reading image data for the determined scanning position from the image data memory 54. For this purpose, the address generating circuit 53 gives that address to the image data memory 54. The image data memory 54 provides the data stored in the given address to a color look-up table unit 55. Based on the provided data, the color look-up table unit 55 provides an RGB (Red, Green and Blue) signal.

In such an image display control device, in order to display a plurality of patterns in an overlapping manner or moving a part of a display image independently, it is necessary to provide a number of sets of image data memories such as the memory 54 and address generating circuits such the circuit 53, which number corresponds to the number of plurality of patterns. In particular, a component such as the image data memory is relatively expensive, and, therefore, such a provision may result in a high cost of the image display control device.

Japanese Patent Publication No.3-79733 discloses a 'scroll system for optional pattern of computer'. In the disclosed system, a single image data memory is needed for displaying a plurality of patterns.

However, in such a system, an address operation circuit is provided for each pattern. Then, before reading image data from the image data memory, a display priority order determining circuit determines a display priority order from active signals provided by those address operation circuits. When a plurality of patterns are displayed in an overlapping manner, the highest priority order image data is read out from the image data memory. In such a system, it is not possible to perform image display control, for each dot, in which a transparent attribute can be given to image data. Also, when the pattern having the highest priority order has a transparent attribute, the pattern of the subsequent priority order is displayed instead of the transparent-attribute pattern. Therefore, such a system may not be suitable for image processing in a personal computer, video game machine and so forth.

SUMMARY OF THE INVENTION

The present invention has been made in view of the foregoing circumstances, and an object of the present invention is to provide an image display control device in which the entirety of respective image data of a plurality of patterns, and, various image display processing can be performed.

An image display control device according to the present invention comprises:

- a first storage device for storing a plurality of patterns of image data;
- an offset register for storing values which indicate definition starting positions from which display image data are defined from said plurality of patterns of image data, respectively;
- a horizontal direction counter for counting dots in a horizontal scanning direction;
- a vertical direction counter for counting lines in vertical scanning direction;
- a first storage device control circuit for successively generating address and control signals for reading a respective line of said display image data from said first storage device within one horizontal scanning period, based on the values of said offset register and the value of said vertical direction counter;
- two second storage devices, each having a storage capacity for storing a thus-read respective line of said image data;
- a second storage device writing circuit for writing thus-read image data at addresses of a predetermined one of said two second storage devices, said addresses corresponding to displaying dots of said image data;
- a second storage device reading circuit for reading, according to the value of said horizontal direction counter, image data stored in a predetermined one of said two second storage devices; and
- a control circuit for controlling said second storage device writing circuit and said second storage device reading circuit so that an image data writing operation and an image data reading operation are performed alternately between said two second storage devices for each horizontal scanning period.

Within one horizontal scanning period, from one of the two second storage devices, one horizontal scanning line of the display image data of the plurality of patterns of image data are read out, while, in the other one of the two second storage devices, the subsequent horizontal scanning line of the display image data is written. By employing the two second storage devices, it is possible to perform a writing operation on one of them during a reading operation being performed on the other one. By performing processing for preventing transparency code data from being written in the writing operation, for example, it is possible that, if a pattern of a higher priority order is transparent, a pattern of the subsequent priority order can be actually displayed. Further, by changing the values of the offset register individually, it is possible to perform individual scrolling operations for a plurality of screen images.

It may be that the image display control device further comprises:

- a X-direction register for storing values which indicate X-direction sizes of said display image data measured from said definition starting positions of said plurality of patterns of image data, respectively;
- a Y-direction register for storing values which indicate Y-direction sizes of said display image data measured from said definition starting positions of said plurality of patterns of image data, respectively; and
- an arrangement-starting-point register for storing values which indicate arrangement-starting-positions from which said display image data of said plurality of patterns of image data are positioned in an imaginary coordinate plane, respectively;

wherein:

said first storage device control circuit successively generates address and control signals for reading a respective line of said display image data from said first storage device, based on the values of said arrangement-starting-point register, the values of said offset register, the value of said vertical direction counter and the values of said Y-direction register.

Thereby, a partial image (for example, a picture of a small airplane) can be defined in a certain pattern. Then, by successively (for example, for each frame) shifting the respective value of the arrangement-starting-point register for determining a position of the partial image in the imaginary coordinate plane, it is possible to move the picture of the small airplane in a display screen. Further, by changing the respective value of the offset register into a value for another partial image (for example, a picture of a helicopter) of the same pattern, the currently displayed airplane can be replaced by the helicopter instantaneously. Further, it may be that a size of a partial image (to be used as a background image) defined in a certain pattern is made to be larger than the size of the display screen, and, this partial image is made to have a priority order lower than a priority order of the above-mentioned airplane. Then, by successively shifting the position at which the partial image of the background image is positioned on the imaginary coordinate plane, a background of the airplane is scrolled in the display screen.

It may be that the image display control device further comprises a priority order register for storing a value indicating a display priority order of said plurality of patterns of image data, wherein said first storage device control circuit controls, based on said display priority order, an order in which said display image data of said plurality of patterns of image data are read from said first storage device.

Only by rewriting the value of the priority order register, the display image data of the plurality of patterns are read from the first storage device in the reverse order to the priority order. This avoids a need for an operation where image data of the plurality of patterns which were read out from the first storage device are then rearranged according the priority order.

It may be that said first storage device has a RAM port and a serial port; and said first storage device control circuit performs a writing operation based on instructions of a CPU to said RAM port of said first storage device, and, also, provides to said RAM port instructions for transferring image data from a RAM to said serial port, thereby said display image data being output through said serial port.

The first storage device control circuit merely needs to provide instructions, to the first storage device via the RAM port, for transferring a scan line of image data to the serial port. The transferred scan line of image data is automatically output without needing any further instructions to be provided by the first storage device control circuit. Thus, a time required of the first storage device control circuit for transferring image data from the first storage device can be effectively reduced. Thereby, it is possible to create a time during which new particular object images can be drawn in the storage area of the first storage device via the RAM port through the CPU and rapidly achieve such new particular object image being drawn in the first storage device.

It may be that the image display control device further comprises an image mode setting register for storing values indicating how a storage area of said first storage device is divided into image data storage areas for said plurality of patterns of image data, and indicating how said image data storage areas are assigned for said plurality of patterns of image data, wherein said first storage device control circuit, based on the values of said image mode setting register, generates address and control signals for said first storage device.

If the image mode setting register is not employed, and, for example, the storage area of the first storage device is divided into four image data storage areas, these four image data storage areas are assigned for the plurality of patterns of image data in a predetermined priority order. In this case, when two identical particular object image portions are to be actually displayed on the display screen at the same time, it is necessary to previously draw the same particular object image also in another image data storage area. By employing the image mode setting register, it is possible to arbitrarily set how to assign such division image data storage areas of the first storage device for the plurality of patterns of image data, as well as how to divide the storage area of the first storage device into the division image data storage areas. Therefore, the storage area of the first storage device is divided into two image data storage areas, a first division image data storage area is assigned for a pattern and also a second pattern of the image data, and the second division image data storage area is assigned for a third pattern of image data and also a fourth pattern of image data. It is possible that the second pattern of image data is positioned to be coincident with the first pattern of image data. It is possible that a particular object image portion once defined as the first pattern of the image data is again defined as the second pattern of the image data. Thus, this particular object image portion is read from the first storage device twice, and is actually displayed twice in the display screen at the same time. By setting arrangement-starting positions of the display image data of the first and second patterns of image data, different from each other, in the arrangement-starting position register, it is possible that that particular object image portion is displayed twice at different positions in the display screen at the same time. Further, it is also possible that the number of bits prepared for each dot in the first division image data storage area is larger than the number of bits prepared for each dot in the second division image data storage area. The first division image data storage area 17*a* may be used for drawing pictures and the second division image data storage area may be used for text.

DETAILED DESCRIPTIONS OF PREFERRED EMBODIMENTS

A first embodiment of the present invention will now be described with reference to accompanying drawings.

Figure 2:
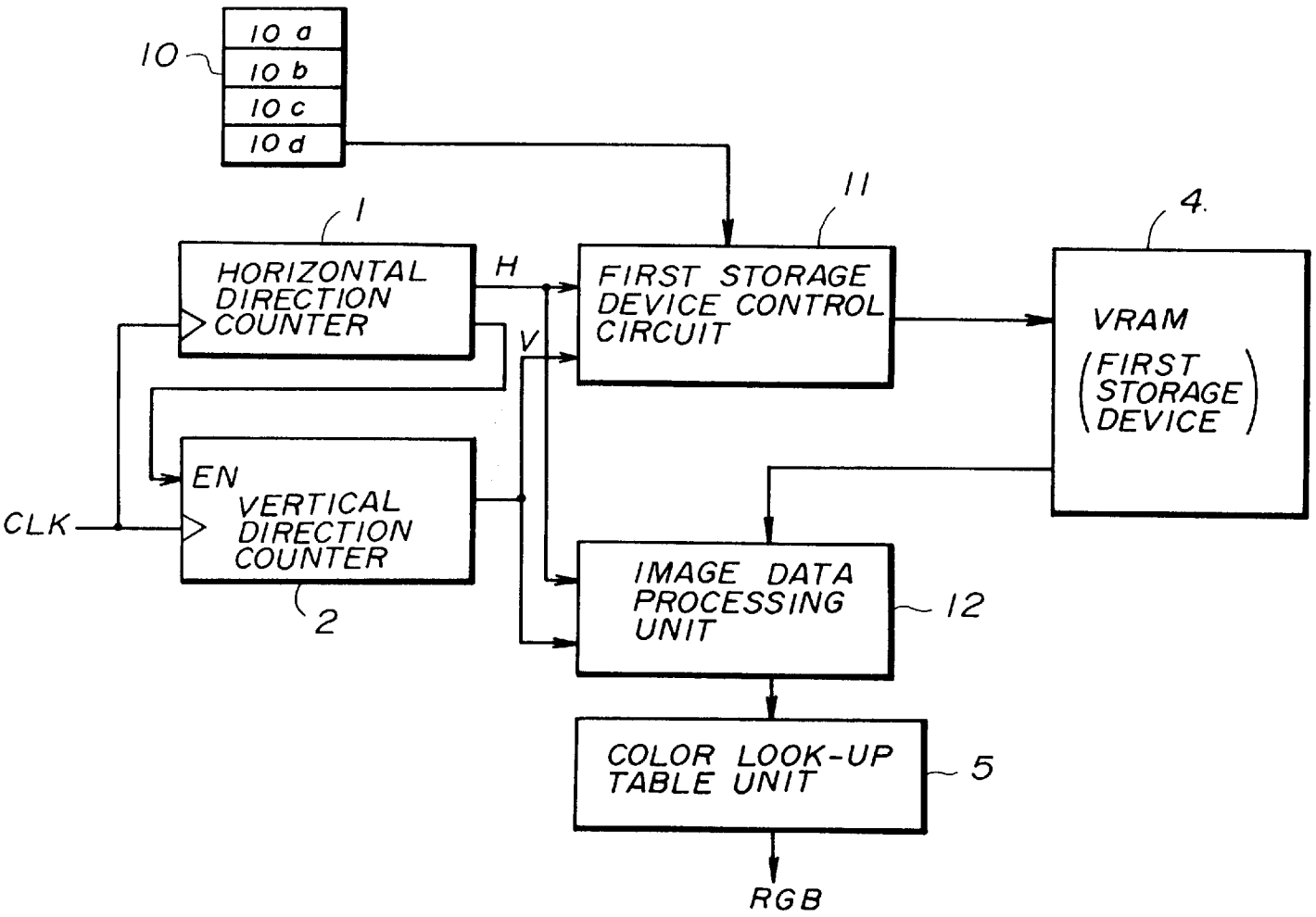
FIG. 2 shows a block diagram of an image display control device in a first embodiment of the present invention.

FIG. 2 shows a block diagram of a general configuration of an image display control device in the first embodiment.

A horizontal direction counter 1 counts given dot clock pulses (CLK), each pulse indicating a display period for a respective dot. A count value of the horizontal direction counter 1 represents data which indicates a dot display position in the horizontal direction in one horizontal period which includes a horizontal retrace period. The horizontal-direction counter 1 provides a vertical count enable signal each time a count value of the counter 1 goes around, that is, when the above-mentioned one horizontal period elapses.

A vertical direction counter 2 counts the dot clock pulses each time receiving the vertical count enable signal from the horizontal direction counter 1. A count value of the vertical direction counter 2 represents data which indicates a dot display position in the vertical direction in one screen image display period (vertical period) including a vertical retrace period.

Figure 3A:
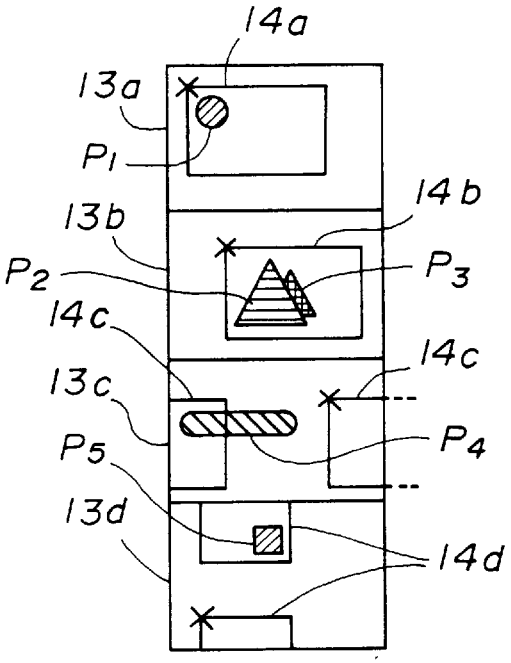
FIG. 3A illustrates four background screen images in the first embodiment.
Figure 3B:
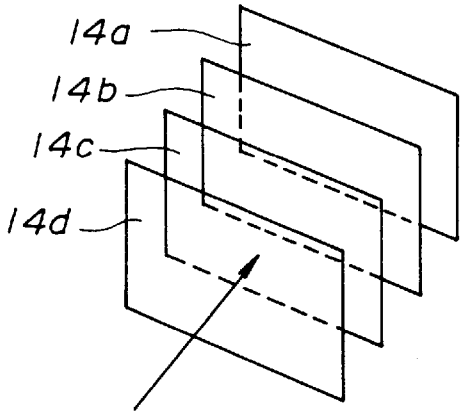
FIG. 3B illustrates a priority order of four display screen images in the first embodiment.

A VRAM (Video Random Access Memory) (first storage device) 4 stores a plurality of patterns, each pattern (hereinafter referred to as a 'background screen image') having an area larger than the area of a predetermined display screen. FIG. 3A conceptually illustrates the plurality of background screen images and 'display screen images' which will be described later, stored in the VRAM 4. In the first embodiment, the number of background screen images is four. In FIG. 3A, four identically sized vertically arranged rectangles 13*a*, 13*b*, 13*c* and 13*d* correspond to the four background screen images, respectively. Small rectangles 14*a*, 14*b*, 14*c* and 14*d*, contained in the four rectangles 13*a*, 13*b*, 13*c* and 13*d*, respectively, correspond to the above-mentioned display screen images. It is noted that the display screen images 14*a* and 14*b* are the complete rectangles contained in the respective background screen images 13*a* and 13*b*, respectively. However, the left half of the display screen image 14*c* is located in the right end portion of the background screen image 13*c*, and the right half of the display screen image 14*c* is located in the left end portion of the background screen image 13*c*. Similarly, the bottom portion of the display screen image 14*d* is located in the top end portion of the background screen image 13*d*, and the top portion of the display screen image 14*d* is located in the bottom end portion of the background screen image 13*c*. Each display screen image is defined within and is a part of a respective background screen image. As mentioned above, each background screen image has an area larger than the area of the predetermined display screen. Each display screen image is defined within a respective background screen image and, thus, has the area which is actually displayed on the predetermined display screen. In each background screen image, a symbol 'x' represents a definition starting point from which a display screen image is defined within the background screen image. FIG. 3B shows a priority order of the four background screen images 14*a*, 14*b*, 14*c* and 14*d*. In FIG. 3B, a background screen image located closer to the viewer has a higher priority order.

In FIG. 2, an offset register 10 is provided with a first register portion 10*a*, second register portion 10*b*, third register portion 10*c* and fourth register portion 10*d*. The first register portion 10*a* stores a value which indicates the above-mentioned definition starting point in the first background screen image 13*a*. Similarly, the second, third and fourth register portions 10*b*, 10*c* and 10*d* store values which indicate those definition starting points in the second, third and fourth background screen images 14*b*, 14*c* and 14*d*, respectively. The values stored in those register portions 10*a*–10*d* are provided to a first storage device control circuit 11.

The first storage device control circuit 11 receives the values from the register portions 10*a*–10*d*, and, also, receives the count values from the above-described horizontal direction counter 1 and vertical direction counter 2. For the first background screen image 13*a*, based on the count value of the vertical direction counter 2 and the value of the first register portion 10*a*, the control circuit 11 produces an address signal and a reading control signal, and provides the produced signals to the VRAM 4. Similarly, for the second, third and fourth background screen images 13*b*, 13*c* and 13*d*, based on the count value of the vertical direction counter 2 and the values of the second, third and fourth register portions, the control circuit 11 produces address signals and reading control signals, and provides the produced signals to the VRAM 4, respectively.

When the address signals and reading control signals are provided to the VRAM 4, the VRAM 4 outputs, successively, the first scan line of image data of the first background screen image starting from a predetermined position in that screen image, the first scan line of image data of the second background screen image starting from a predetermined position in that screen image, the first scan line of image data of the third background screen image starting from a predetermined position in that screen image, and the first scan line of image data of the fourth background screen image starting from a predetermined position in that screen image.

An image data processing unit 12 receives the image data from the VRAM 4, and the count values from the horizontal direction counter 1 and vertical direction counter 2.

Figure 4:
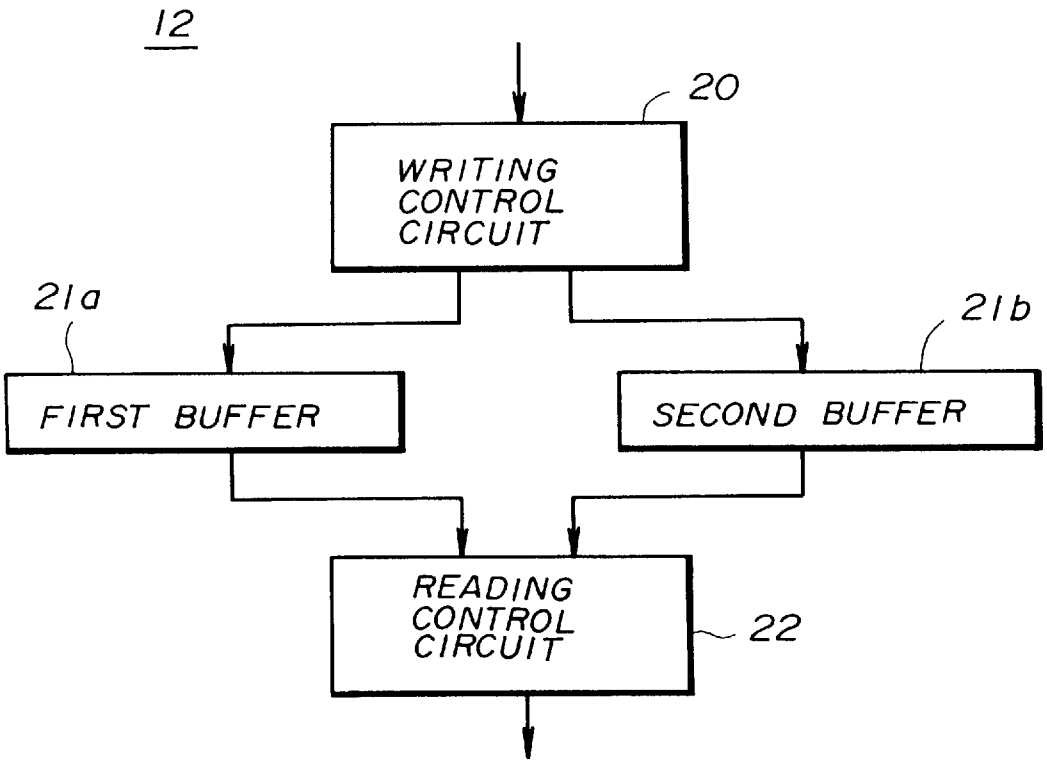
FIG. 4 shows a block diagram of an image data processing unit shown in FIG. 2.

FIG. 4 shows a block diagram of a specific configuration of the image data processing unit 12. The image data processing unit 12 includes a first buffer (second storage device) 21*a* and a second buffer (second storage device) 21*b*.

Each of the two buffers 21*a* and 21*b* has a storage capacity corresponding to the number of dots for each horizontal scan line display period. Each of the buffers 21*a* and 21*b* initially stores a transparency code ("00h", in a case where image data is represented by 8-bit digital data, for example), which indicates transparency, in each of the entire addresses. When the transparency code is input to a color look-up table unit 5, the color look-up table outputs an RGB signal of a predetermined color.

A writing control circuit 20 receives the image data from the VRAM 4, and writes the received image data in the first buffer 21*a* and second buffer 21*b* alternately for one horizontal line by one horizontal line. Further, when writing the image data in the buffers 21*a* and 21*b*, the writing control circuit 20 determines whether or not the image data is the transparency code "00h". In the case of the transparency code, no image data writing is performed. In a case where the received image data are codes other than the transparency code, that image data is written in addresses for respective dots. In an example shown in FIGS. 3A–3C, for all the remaining areas other than those of particular object images $P_1$, $P_2$, $P_3$ and $P_4$ in the respective display screen images 14*a*, 14*b*, 14*c* and 14*d*, the transparency codes are given, in the VRAM 4.

A reading control circuit 22 performs an image data reading operation on the second buffer 21*b* during an image data writing operation being performed on the first buffer 21*a* by the writing control circuit 20. Similarly, the reading control circuit 22 performs an image data reading operation on the first buffer 21*a* during an image data writing operation being performed on the second buffer 21*b* by the writing control circuit 22. Further, the transparency code is written in an address of the buffers 21*a* and 21*b* after the image data is read out from that address by the reading control circuit 22.

Figures 5A, 5B, 5C:
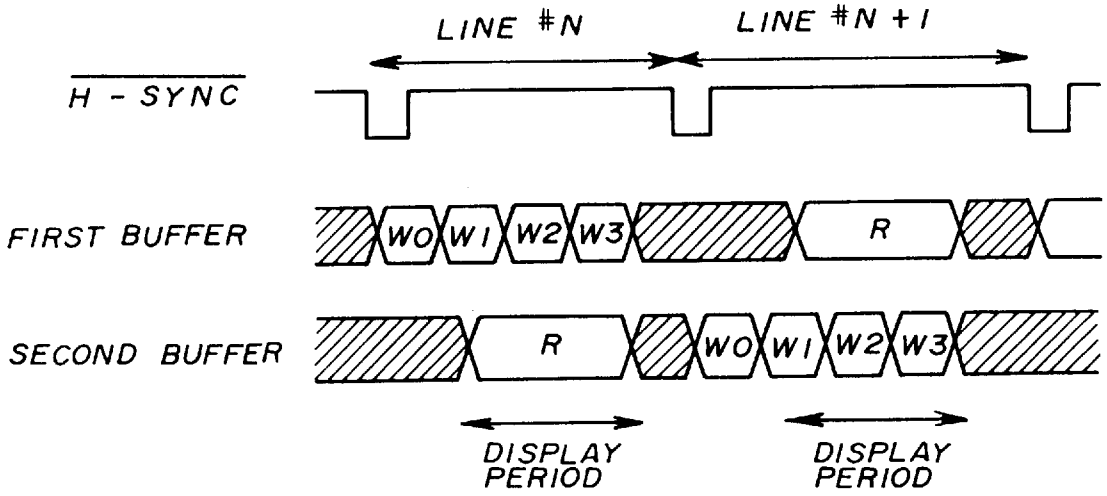
FIGS. 5A, 5B and 5C illustrate time charts of data writing/reading operations performed by the image data processing unit shown in FIG. 4.

FIGS. 5A, 5B and 5C show a time chart illustrating operations concerning the first and second buffers 21*a* and 21*b* with respect to a behavior of a horizontal synchronization signal (H-SYNC) shown in FIG. 5A. (The horizontal synchronization signal is provided by the vertical direction counter 2.) In a line #n horizontal period of the H-SYNC signal, image data W0, W1, W2 and W3 is written in the first buffer 21*a* in an overwriting manner. Then, during a display period of the subsequent line #n+1 horizontal period in the H-SYNC signal, the thus-overwriting-manner-written image data W0, W1, W2 and W3 is read out from the first buffer 21*a*. The image data W0 is one scan line of image data of the first display screen image 14*a* shown in FIG. 3A, the image data W1 is the same scan line of image data of the second display screen image 14*b*, the image data W2 is the same scan line of image data of the third display screen image 14*c* and the image data W3 is the same scan line of image data of the display screen image 14*d*.

Figure 3C:
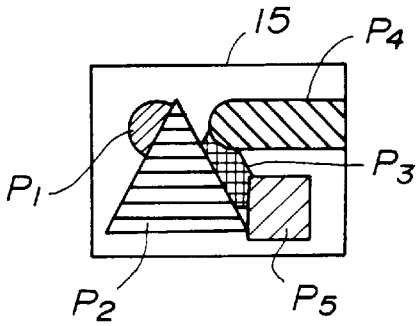
FIG. 3C illustrates a final screen image obtained as a result of integrating the four display screen images shown in FIG. 3A.

During the same line #n+1 horizontal period of the H-SYNC signal, image data W0, W1, W2 and W3 which is the subsequent scan line of image data of the first, second, third and fourth display screen images 14*a*, 14*b*, 14*c* and 14*d* is written in the second buffer 21*b*. Such parallel image data writing and reading operations are repeatedly performed from a scan line which is immediately antecedent to the first scan line of the above-mentioned display screen to the last scan line of that display screen. By this series of operations, as shown in FIG. 3C, a screen image 15 is obtained.

In fact, for each scan line, the four display screen images 14*a*, 14*b*, 14*c* and 14*d* are overwritten in one of the buffers 21*a* and 21*b* in the overwriting manner. The obtained line of image data is provided to the color look-up table unit 5 which then provides an RGB signal of the line of image data. The area of the resulting screen image 15 is the same as the area of each of the display screen images 14*a*, 14*b*, 14*c* and 14*d*. As a result, the four display screen images 14*a*, 14*b*, 14*c* and 14*d* are overwritten in the above-mentioned order, and thereby the final display screen image 15 shown in FIG. 3C is obtained. In those operations, the particular object image $P_1$ is located at the top left in the final image as the object image $P_1$ is located at the top left in the first display image 14*a*. Similarly, the particular object images $P_2$ and $P_3$ are located at the left in the final image as those object images $P_2$ and $P_3$ are located at the left in the second display image 14*b*.

In the case of the third display screen image 14*c*, as mentioned above, the left end of the screen image 14*c* is located at the right end of the background screen image 13*c*, and the right end of the display screen image 14*c* is located at the left end of the background screen image 13*c*. In this case, the particular object image $P_4$, only a left portion thereof being defined by the third display screen image 14*c*, is located at the right side of the display screen image 14*c*, and, the particular object image $P_4$ is located at the right of the final screen image 15. Such a case occurs as a result of an operation in which the display screen image is moved rightward until the right edge of the display screen image reaches the right edge of the background screen image, then, the display screen image is further moved rightward, and the right edge of the display screen image appears from the left edge of the background screen image, as the display screen image 14*c* shown in FIG. 3A.

In the case of the fourth display screen image 14*d*, it is noted that the left end of the display screen image 14*d* is located at the bottom left of the background screen image 13*d*, and the right end of the display screen image 14*d* is located at the top left of the background screen image 13*d*. In this case, the particular object image $P_5$ is located at the bottom right of the display screen image 14*d*, and is located at the bottom right of the final screen image 15, as shown in FIG. 3C. Such a case occurs as a result of an operation in which the display screen image is set vertically and the right edge thereof is located at the top and the left edge thereof is located at the bottom, although the display screen image is set horizontally in every other case. Then, the display screen image is moved upward until the right edge of the display screen image reaches the top edge of the background screen image. Then, the display screen image is moved further upward the right edge of the display screen image appears from the bottom edge of the background screen image, as the display screen image 14*d* shown in FIG. 3A.

As the display screen image 14*d* has the highest priority order as shown in FIG. 3B, the particular object $P_5$ has the complete shape in the final screen image 15 which is the same as that in the display screen image 14*d*. In contrast to this, as the display screen image 14*a* has the lowest priority order as shown in FIG. 3B, a right bottom portion of the particular object $P_1$ is hidden by the particular object $P_2$ in the final screen image 15.

In the first embodiment, as shown in FIG. 4, the two buffers 21*a* and 21*b* are provided, an image data writing operation and an image data reading operation are performed simultaneously and alternately between the two buffers. Thereby, while the image reading operations are performed in a real-time manner in synchronization with the H-SYNC signal as shown in FIGS. 5A, 5B and 5C, it is possible that the transparency code data is prevented from being written. As a result, it is possible that, in a case where a pattern having a higher priority order is transparent, a subsequent priority order pattern is displayed. For example, although the second display screen image 14*b* has a priority order higher than a priority order of the first display screen image 14*a*, the first screen image 14*a* is displayed partially where the second screen image 14*b* is transparent, as shown in FIG. 3C. In fact, the particular object image $P_1$ of the first display screen image 14*a* is partially displayed as the final screen image 15, which is actually displayed on the display screen, shown in FIG. 3C.

Further, by gradually changing the values of the register portions 10*a*, 10*b*, 10*c* and 10*d*, it is possible to gradually change address values provided to the VRAM 4 via the first storage device control circuit 11. It is possible to shift, dot by dot, the above-described definition starting point of the display screen images 14*a*, 14*b*, 14*c* and 14*d*. As a result, it is possible to 'scroll' those display screen images 14*a*, 14*b*, 14*c* and 14*d* on the background screen images 13*a*, 13*b*, 13*c* and 13*d*, respectively, individually. The particular object images $P_1$, $P_2$, $P_3$, $P_4$, $P_5$ are drawn at certain positions, respectively, in the background screen images through certain processing by a CPU. In such a condition, by 'scrolling' (arbitrarily between horizontally and vertically by placing a display screen image horizontally and vertically as described above), that is, by arbitrarily moving a display image region definition window in a predetermined background screen image, it is possible to place, at any position in a final screen image, a particular object image which is provided at a certain position in the background screen image.

Figure 1:
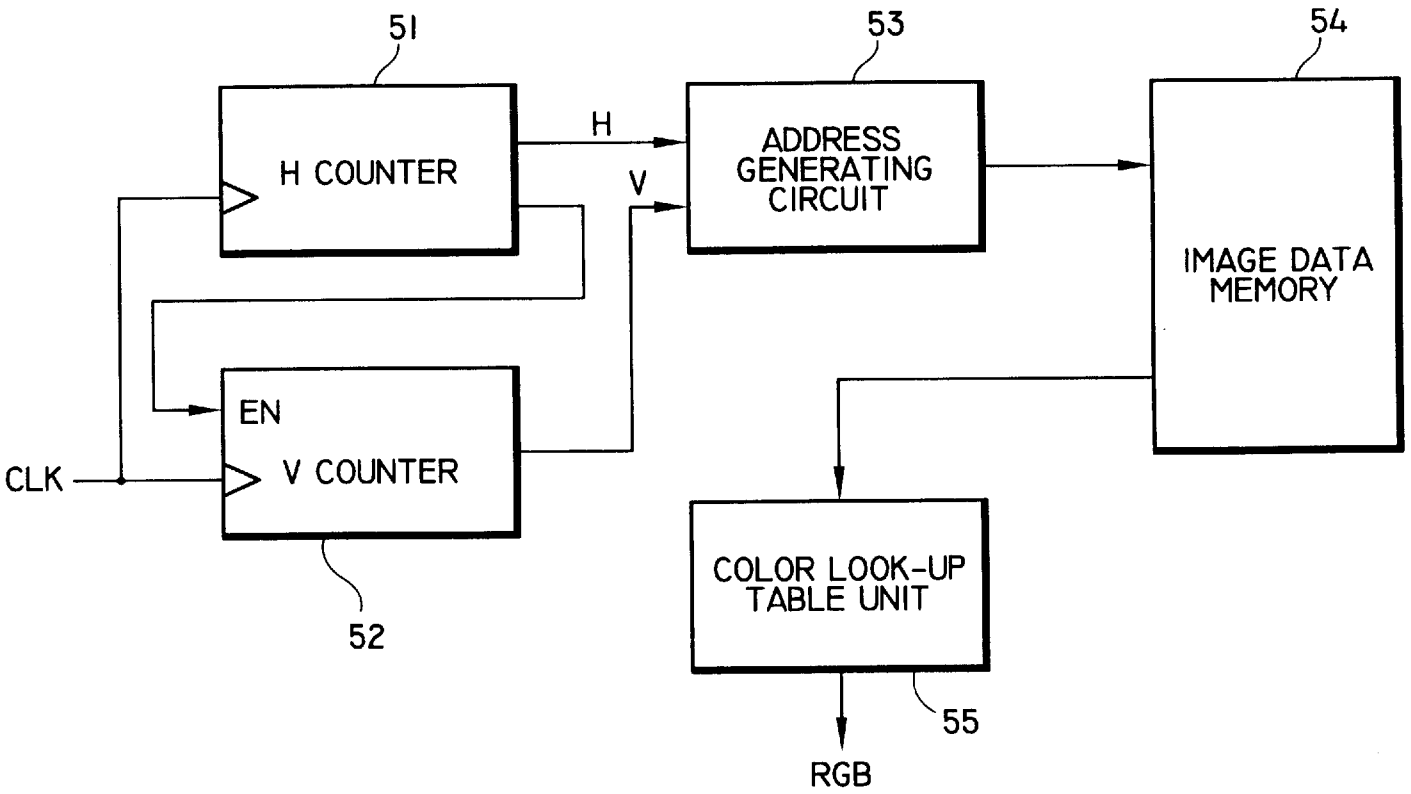
FIG. 1 PRIOR ART
FIG. 1 shows a block diagram of the related art.

For example, when such a system as the first embodiment of the present invention described above is used in a car navigation system, the background screen images 13*a*, 13*b*, 13*c* and 13*d* shown in FIGS. 3A–3C may be allocated for displaying main roads, for displaying branch roads, for displaying building pictures and for displaying text information, respectively. In such an application, it is possible that the four display screen images 14*a*, 14*b*, 14*c* and 14*d* scroll in a common manner. In such a case, it is possible to provide only one offset register portion in the offset register 10 shown in FIG. 1 which is common for the four display screen images. Furthermore, it is also possible that the number of bits allocated for each dot can be reduced for the display screen image only for text information, and, instead, the number of the display screen images only for text information can be increased. By reducing the number of bits allocated for each bit, the number of colors which can be expressed is reduced.

Figure 6:
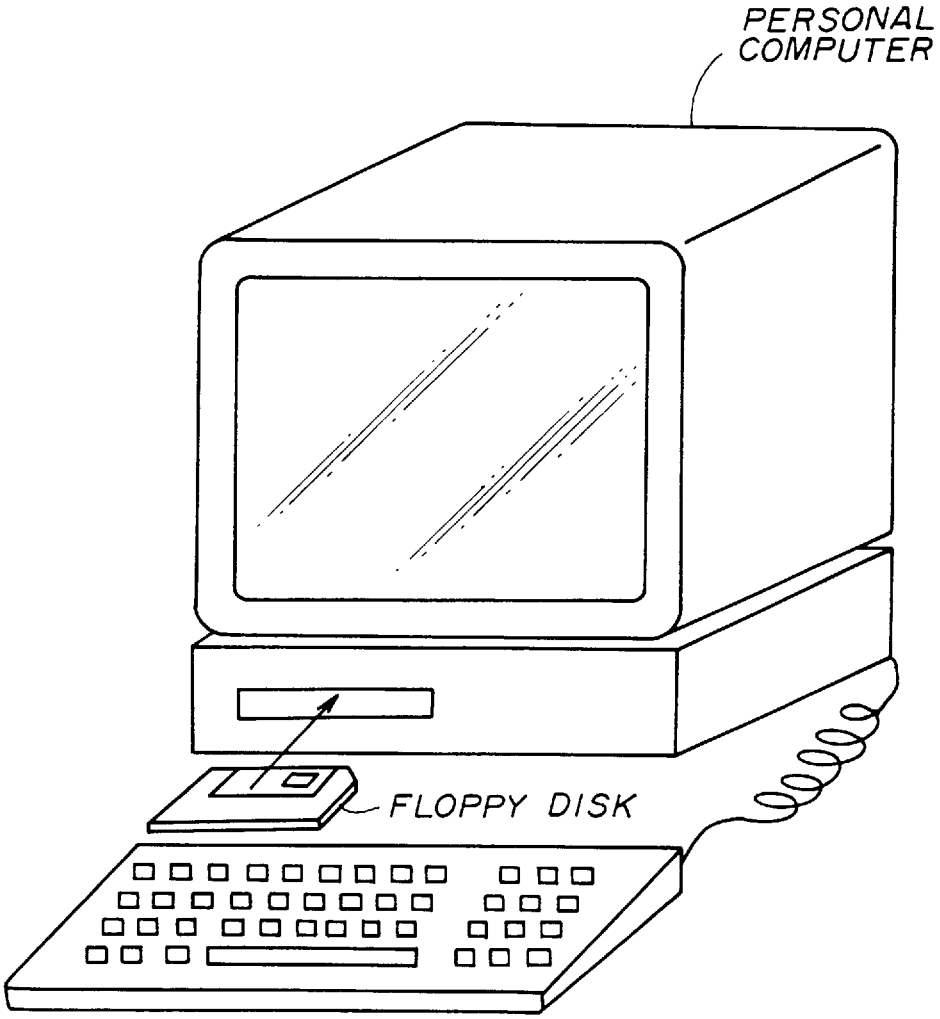
FIG. 6 shows a configuration of variant embodiments of the first embodiment and a second embodiment of the present invention.
Figure 7:
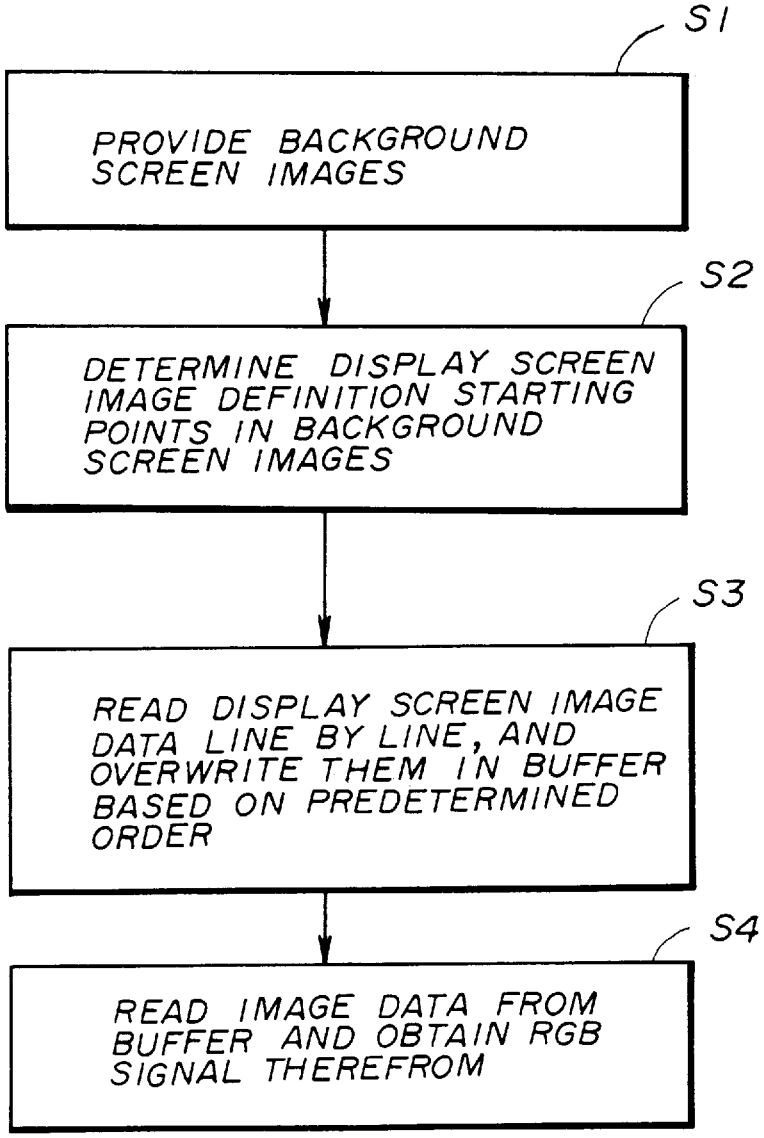
FIG. 7 shows a general operation flow of operations performed by the first embodiment and variant embodiment of the present invention.

Further, functions similar to those of the above-described first embodiment of the present invention shown in FIG. 2 can also be performed, as a variant embodiment of that first embodiment, through a general-purpose computer, such as a personal computer shown in FIG. 6, that includes appropriate information storage devices such as a hard disk drive device, a floppy disk drive device, a ROM, a RAM and/or the like, and is specially configured by predetermined software stored in a computer-usable medium such as a floppy disk shown in FIG. 6. FIG. 7 shows a general operation flow of the first embodiment of the present invention. In a step S1 (hereinafter, the term 'step' being omitted), the background screen images such as 13*a*–13*d* are prepared in a memory such as the VRAM 4. In S2, within the background screen images, display screen images such as 14*a*–14*d* are defined by determining the definition starting points therefor, respectively. In S3, the display screen image data is read from the memory, line by line, and, then, is overwritten in a buffer such as the buffers 21*a* and 21*b*, in a predetermined order of the display screen images. In S4, the image data is read out from the buffer and an RGB signal is obtained from the read image data through a look-up table such as that of the look-up table unit 5. Operations such as those described with reference to FIG. 7 can be performed through the above-mentioned general-purpose computer specifically configured to carry out those operations by the software specifically produced for performing those operations.

Figure 8:
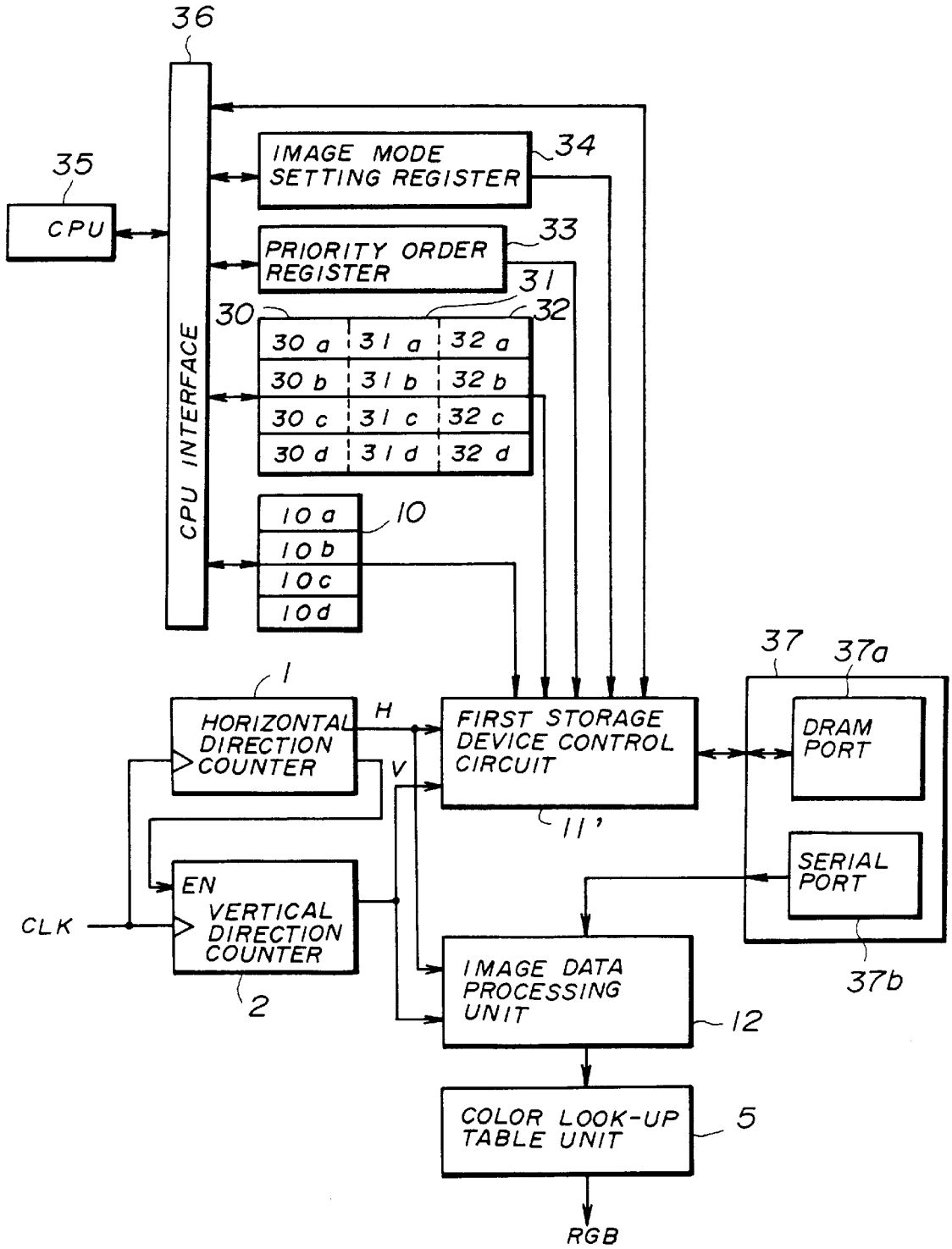
FIG. 8 shows a block diagram of an image display control device in the second embodiment.

With reference to FIG. 8, which shows a block diagram of an image display control device in a second embodiment of the present invention, this image display device will now be described. For parts/components of the image display control device in the second embodiment, which have functions identical to those of the corresponding parts/components of the above-described image display control device in the first embodiment, the same reference numerals are given thereto and descriptions thereof will be omitted.

An X-direction register 31 is provided with four register portions 31*a*, 31*b*, 31*c* and 31*d*. Each of these register portions 31*a*, 31*b*, 31*c* and 31*d* stores a value which indicates a X-direction size of a respective one of the display screen images 14*a*, 14*b*, 14*c* and 14*d*. Each of these X-direction sizes is measured from a respective one of the above-mentioned definition starting points in the respective background screen images 13*a*, 13*b* 13*c* and 13*d*, the value of which point is stored in the respective one of the above-mentioned register portions 10*a*, 10*b*, 10*c* and 10*d* of the offset register 10. Similarly, a Y-direction register 32 is provided with four register portions 32*a*, 32*b*, 32*c* and 32*d*. Each of these register portions 32*a*, 32*b*, 32*c* and 32*d* stores a value which indicates a Y-direction size of a respective one of the display screen images 14*a*, 14*b*, 14*c* and 14*d*. Each of these Y-direction sizes is measured from a respective one of the above-mentioned definition starting points in the respective background screen images 13*a*, 13*b* 13*c* and 13*d*, the value of which point is stored in the respective one of the above-mentioned register portions 10*a*, 10*b*, 10*c* and 10*d* of the offset register 10.

Figure 10:
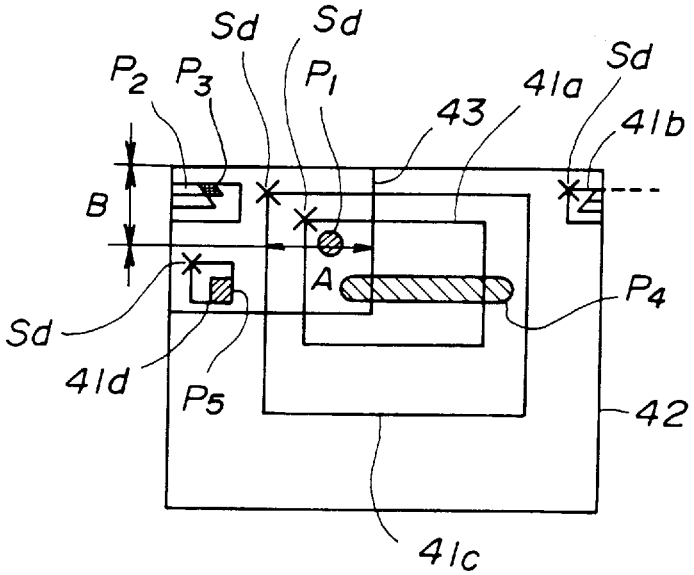
FIG. 10 illustrates an arrangement, using values of an arrangement-starting-point register, of the display screen images in an imaginary coordinate plane, in the second embodiment.

An arrangement-starting-point register 30 is provided with four register portions 30*a*, 30*b*, 30*c* and 30*d*. Each of the four register portions stores a value which indicates a display starting position in an imaginary coordinate plane 42 (shown in FIG. 10), at which position a respective one of the display screen images 14*a*, 14*b*, 14*c* and 14*d* starts in the imaginary coordinate plane 42, as shown in FIG. 10. In other words, values of the register portions 30*a*, 30*b*, 30*c* and 30*d* determine positions which are the top-left corners of the display screen images, respectively, in the imaginary coordinate plane 42. In the example shown in FIG. 10, display screen images 41*a*, 41*b*, 41*c* and 41*d* start from the display starting positions Sd (also indicated by the symbol 'X') in the imaginary coordinate plane 42.

A first storage device control circuit 11', based on the value of the arrangement-starting-point register 30, the value of the offset register 10, the value of the vertical direction counter 2 and the value of the Y-direction register 32, generates the address and the control signal for reading a scan line of image data from the VRAM 37 for a selected one of the background screen images 13*a*, 13*b*, 13*c* and 13*d*, successively.

Figure 9A:
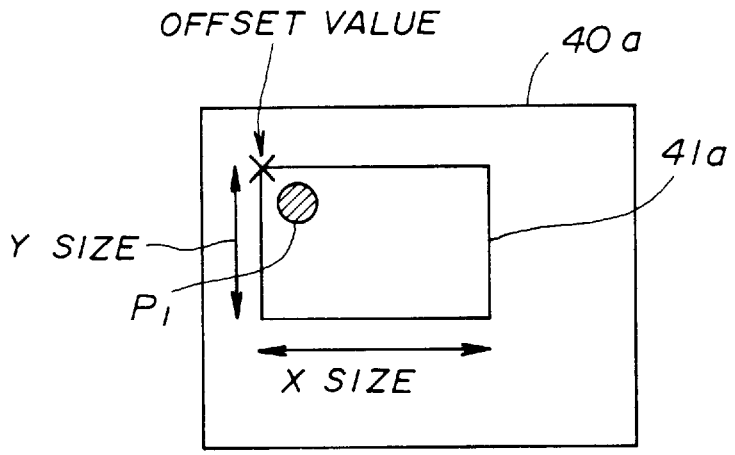
FIGS. 9A and 9B illustrate display screen image definition operations in the second embodiment using offset values, X sizes and Y sizes.
Figure 9B:
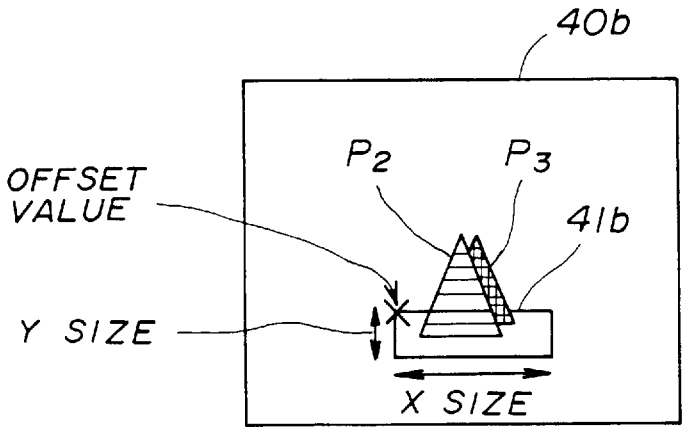

FIG. 9A shows the display screen image 41*a* defined in the first background screen image 40*a* using an offset value of the register portion 10*a* of the offset register 10, a X-size value of the register portion 31*a* of the X-direction register 31, and a Y-size value of the register portion 32*a* of the Y-direction register 32. Similarly, FIG. 9B shows the display screen image 41*b* defined in the second background screen image 40*b* using an offset value of the register portion 10*b* of the offset register 10, a X-size value of the register portion 31*b* of the X-direction register 31, and a Y-size value of the register portion 32*b* of the Y-direction register 32. Similarly, for the third and fourth background screen images, indications in drawings thereof being omitted, using offset values of the register portions 10*c* and 10*d* of the offset register 10, X-size values of the register portions 31*c* and 31*d* of the X-direction register 31, and Y-size values of the register portions 32*c* and 32*d* of the Y-direction register 32, the display screen images 41*c* and 41*d* are defined, respectively.

FIG. 10 shows a conceptional view indicating the defined four display screen image 41*a*, 41*b*, 41*c* and 41*d* are arranged in the imaginary coordinate plane 42. In the second embodiment, only an actual display screen image 43 defined in the imaginary coordinate plane 42 is actually displayed. In this example of FIG. 10, the actual display screen image 43 is defined at a top-left corner of the imaginary coordinated plane 42, as shown in the figure. In this example, as shown in the figure, only a top-left corner portion of the third display screen image 41*c* is included in the actual display screen image 43, and thus only this portion is actually displayed, for example. As described above, each of the display screen images 41*a*, 41*b*, 41*c* and 41*d* can be arranged in an arbitrary position in the imaginary coordinate plane 42 by determining an arrangement-starting-position value of a respective one of the register portions 30*a*, 30*b*, 30*c* and 30*d* of the arrangement-starting-point register 30. It is possible that the value "0" is given to each of the four register portions 30*a*, 30*b*, 30*c* and 30*d* of the arrangement-starting-point register 30. Each of the four points Sd of the four display screen images are coincident with the top-left corner of the imaginary coordinate plane 42.

The first storage device control circuit 11' obtains the addresses of the VRAM 37 from values of the register portions 30*a*, 30*b*, 30*c* and 30*d* of the arrangement-starting-point register 30. Thereby, the control circuit 11' reads, however, only the image data of the actual display screen image 43 for each of the display screen images 41*a*, 41*b*, 41*c* and 41*d*. The read image data is provided to the image data processing unit 12. In an example for the third display screen image 41*c*, when a value of the vertical direction counter 2 indicates the vertical length B shown in FIG. 10, the scan line of image data only within the range A of the display screen image 41*c* is read from the VRAM 37, and is provided to the image data processing unit 12. The image data processing unit 12 processes the provided image data similarly to the case of the above-described first embodiment. Thereby, the actual display screen image 43 is actually displayed on the display screen (not shown in the figures). In this example, as shown in FIG. 10, the actual display screen image includes bottom-right portions of the particular object images $P_2$ and $P_3$, the entirety of the particular object image $P_1$, a left end portion of the particular object image $P_4$ and the entirety of the particular object image $P_5$, and these are actually displayed in the arrangement shown in the figure.

Figure 11:
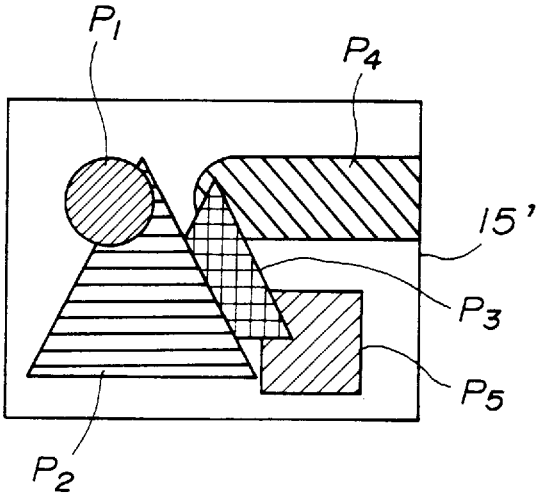
FIG. 11 illustrates a final screen image obtained as a result of integrating the four display screen images shown in FIG. 3A according to another priority order of the display screen images.

A priority order register 33 stores data indicating a predetermined priority order of the above-described four background screen images. The first storage device control circuit 11' receives this data of the predetermined priority order, and, according to the priority order, generates addresses to be provided to the VRAM 37. It is possible to set an arbitrary priority order of the four background screen images. In the above-described first embodiment, as described above with reference to FIG. 3B, the priority order is such that the fourth, third, second and first background screen images, 14*d*, 14*c*, 14*b* and 14*a*, and the image data overwriting order is W0→W1→W2→W3 as shown in FIGS. 5B and 5C. However, by setting data in the priority order register 33, it is possible to use another priority order, and to determine the image data overwriting order to be W3→W2→W1→W0, for example. In this example, the priority order of the background screen images is such that 14*a*, 14*b*, 14*c* and 14*d*, and the screen image 15' shown in FIG. 11 is obtained instead of the above-described screen image 15 shown in FIG. 3C.

An image mode setting register 34 stores data indicating how to divide a storage area of the VRAM 37 into image data storage areas, and how to assign these image data storage areas for the above-described background screen images. The first storage device control circuit 11' generates address signals and control signals based on data of the image mode setting register 34 to the VRAM 37.

Figure 12A:
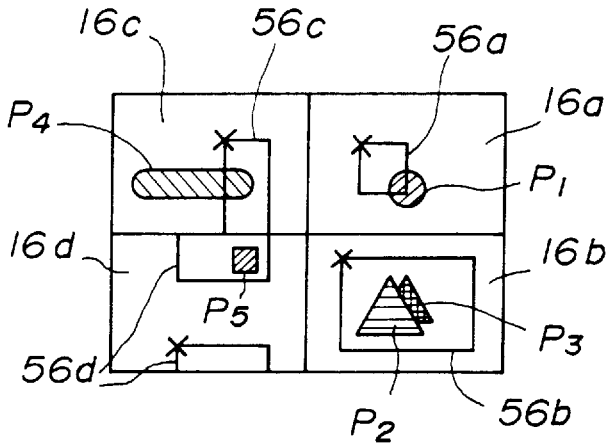
FIGS. 12A, 12B and 12C illustrate division of a storage area of a VRAM shown in FIG. 8.
Figure 12B:
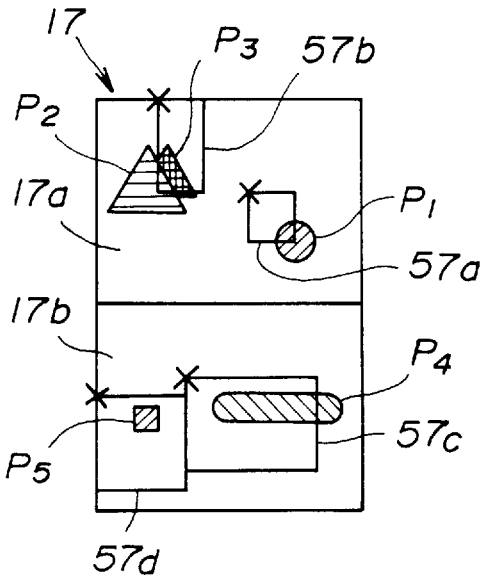
Figure 12C:
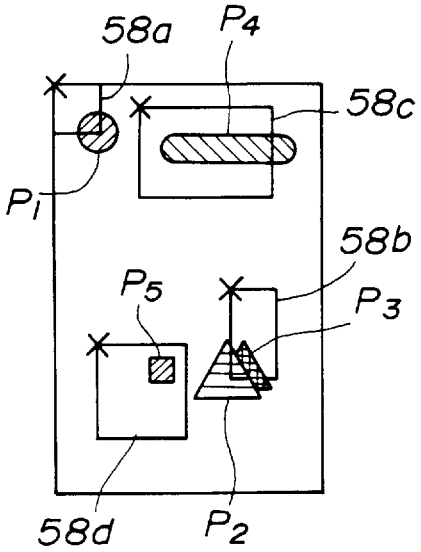

FIGS. 12A, 12B and 12C illustrate examples of the manner of dividing the VRAM 37 storage area. FIG. 12A shows an example in which the storage area of the VRAM 37 is divided into four image data storage areas 16*a*, 16*b*, 16*c* and 16*d*, FIG. 12B shows an example in which the storage area of the VRAM 37 is divided into two image data storage areas 17*a* and 17*b*, and FIG. 12C shows an example in which the storage area of the VRAM 37 is not divided.

In each of these examples shown in FIGS. 12A, 12B and 12C, the storage area of the VRAM 37 has the particular object images $P_1$, $P_2$, $P_3$, $P_4$ and $P_5$ which are drawn therein in a respective arrangement, as show in the figures, through certain processing performed by the CPU 35. In the case of FIG. 12A, if the image mode setting register 34 is not employed, the four image data storage areas 16*a*, 16*b*, 16*c* and 16*d* are assigned for the above-described four background screen images in a predetermined priority order, which may be the priority order set in the priority order register 33. In this case, when two identical particular object image portions are to be actually displayed on the display screen at the same time, for example, when a top-left portion of the particular object image $P_1$ defined by the display screen image 56*a* in the image data storage area 16*a* shown in FIG. 12A is to be displayed twice in the display screen at the same time, it was necessary to previously draw the same particular object image $P_1$ also in another image data storage area, for example, 16*b*.

However, by employing the image mode setting register 34, it is possible to arbitrarily assign such division image data storage areas of the VRAM 37 for the background screen images, as well as how to divide the storage area of the VRAM 37 into the image data storage areas. Therefore, for example, with reference to FIG. 12B, the first division image data storage area 17*a* is assigned for the first background screen image 57*a* and also for the second background screen image 57*b*, and the second division image data storage area 17*b* is assigned for the third background screen image 57*c* and also for the fourth background screen image 57*d*. It is possible that the second background screen image 57*b* is positioned to be coincident with the first background screen image 57*a*. It is possible that a top-left portion of the particular object image $P_1$ defined by the display screen image 57*a* is also defined by the display screen image 57*b* in the image data storage area 17*a* shown in FIG. 12B. Thus, this particular object image portion is read from the VRAM 37 twice, and is actually displayed twice in the display screen at the same time. By setting arrangement-starting positions of the first and second display screen image 57*a* and 57*b*, different from each other, in the arrangement-starting position register 30, it is possible that the particular object image portion is displayed twice at different positions, for example, side by side, in the display screen at the same time. However, in the example shown in FIG. 12B, the first and second display screen images 57*a* and 57*b* are not coincident with each other. Further, it is also possible that the number of bits prepared for each dot in the first division image data storage area 17*a* is larger than the number of bits prepared for each dot in the second division image data storage area 17*b*. Then, the first division image data storage area 17*a* may be used for drawing pictures and the second image data storage area 17*b* may be used for text.

In the example shown in FIG. 12C, the entirety of the storage area of the VRAM 37 is assigned for each of the four background screen images. In this storage area, arbitrary sizes of the display screen images 58*a*, 58*b*, 58*c* and 58*d* can be arranged at arbitrary positions, by setting appropriate data in the offset register 10, X-direction register 31 and Y-direction register 32.

Each of the offset register 10, arrangement-starting-point register 30, X-direction register 31, Y-direction register 32, priority order register 33 and image mode setting register 34 is connected to the CPU 35 via a CPU interface 36. Through data processing operations performed by the CPU 35, the contents of each register can be arbitrarily altered. Further, the CPU 35 is connected with the first storage device control circuit 11' via the CPU interface 36. Under control by the CPU 35, the first storage device control circuit 11' controls the VRAM 37.

In the second embodiment, the VRAM 37 includes a DRAM as the storage area which is assigned for the background screen images as described above. The VRAM 37 uses a DRAM port 37*a* and a serial port 37*b*, as shown in FIG. 8. The first storage device control circuit 11' provides address signals and control signals to the DRAM in the VRAM 37 via the DRAM port 37*a*. Thereby, a scan line of image data stored in the DRAM is transferred to the serial port 37*b*. The scan line of image data is automatically transferred to the image data processing unit 12.

By employing the DRAM port 37*a* and serial port 37*b* in the VRAM 37 as described above, the first storage device control circuit 11' merely needs to provide instructions, to the VRAM 37 via the DRAM port 37*a*, for transferring a scan line of image data to the serial port 37*b*. The transferred scan line of image data is automatically transferred to the image data processing unit 12 without needing any further instructions to be provided by the first storage device control circuit 11'. The time required of the first storage device control circuit 11' for transferring image data from the VRAM 37 to the image data processing unit 12 can be effectively reduced. It is possible to create a time during which new particular object images can be drawn in the storage area of the VRAM 37 via the DRAM port 37*a* through the CPU 35. Thus, it is possible to rapidly achieve such new particular object image being drawn in the VRAM 37.

Figure 13:
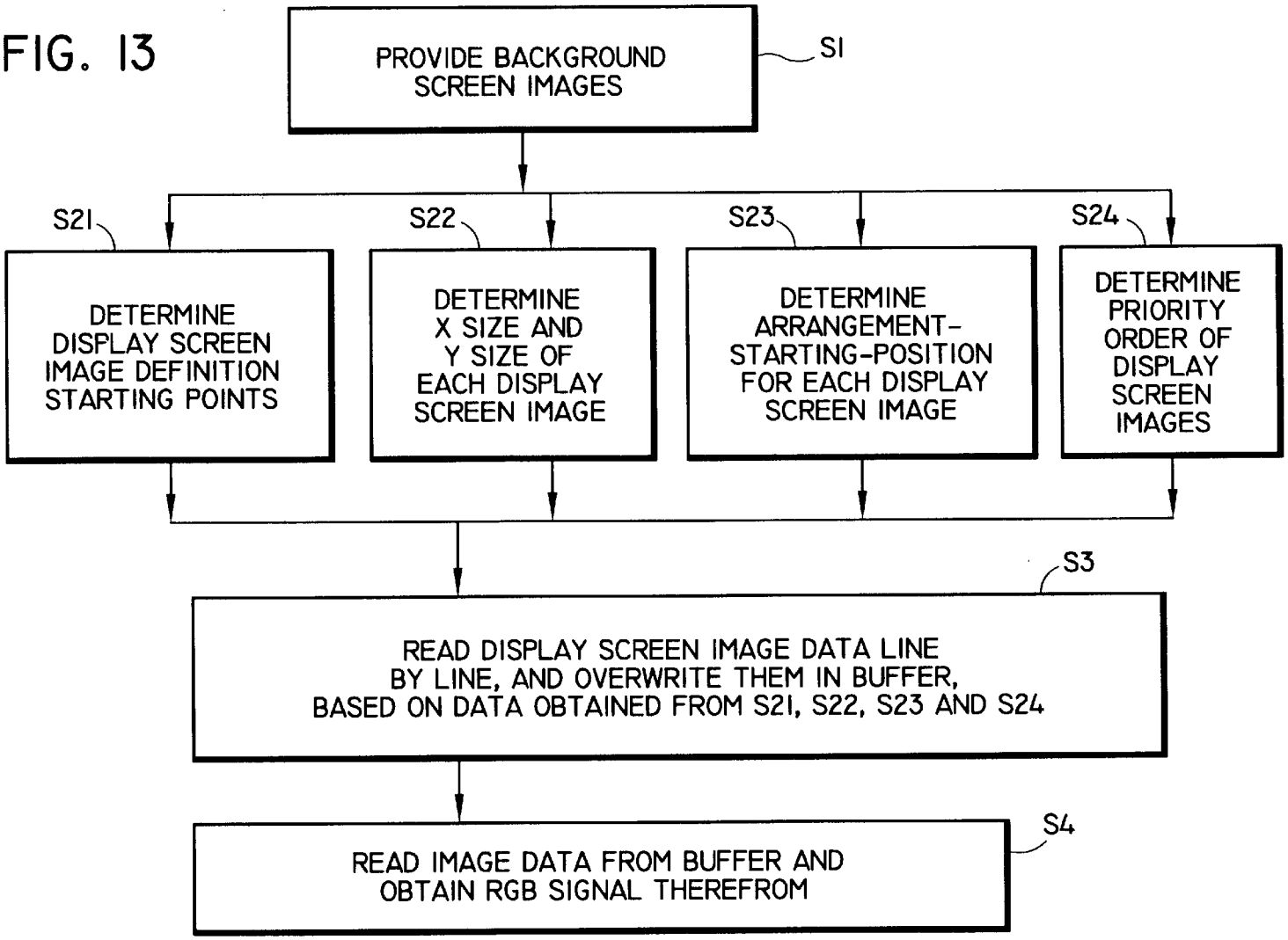
FIG. 13 shows a general operation flow of operations performed by the second embodiment and variant embodiment of the present invention.

Further, functions similar to those of the above-described second embodiment of the present invention shown in FIG. 8 can also be performed, as a variant embodiment of that second embodiment, through a general-purpose computer, such as a personal computer shown in FIG. 6, that includes appropriate information storage devices such as a hard disk drive device, a floppy disk drive device, a ROM, a RAM and/or the like, and is specially configured by predetermined software stored in a computer-usable medium such as a floppy disk shown in FIG. 6. FIG. 13 shows a general operation flow of the second embodiment of the present invention. In S1, the background screen images, having particular object images drawn therein in respective positions, are prepared in the VRAM 37. In S21 and S22, within the background screen images, the display screen images are defined by determining the definition starting points, X sizes and Y sizes therefor, respectively. In S23, arrangement-starting-positions of the defined display screen images are determined, and, in S24, the priority order of the display screen images is defined. In S3, based on the data determined in S21, S22, S23 and S24, the display screen image data is read from the memory, line by line, and is overwritten in a buffer such as the buffers 21*a* and 21*b* of the image data processing unit 12. In S4, the image data is read out from the buffer and an RGB signal is obtained from the read image data through a look-up table such as that of the look-up table unit 5. Operations such as those described with reference to FIG. 13 can be performed through the above-mentioned general-purpose computer specifically configured to carry out those operations by the software specifically produced for performing those operations.

According to the present invention, as described above, it is possible to perform various kinds of image display manners, for example, those in which a plurality of background screen images are superimposed, the entirety or a part of the screen image is scrolled, or identical images are displayed side by side. Further, using the serial port, it is possible to create an extra time during which new image data of the background screen images can be rapidly drawn in the VRAM.

Further, the present invention is not limited to the above-described embodiments, and variations and modifications may be made without departing from the scope of the present invention.

What is claimed is:

1. An image display control device, comprising:

a first storage device for storing a plurality of patterns of image data, each pattern defining a screen having display image data;

an offset register for storing values which define starting positions in said first storage device of the display image data for each screen;

a horizontal direction counter for counting dots in a horizontal scanning direction;

a vertical direction counter for counting lines in vertical scanning direction;

a first storage device control circuit for successively generating address and control signals for reading a respective line of said display image data from each screen from said first storage device within one horizontal scanning period, said address and control signals being based on the values of said offset register and the value of said vertical direction counter;

two second storage devices, each selectively storing a thus-read respective line of said display image data for each screen in a predefined order such that image data of a previously stored pattern is overwritten at least by display image data of a subsequently stored pattern, each of said two second storage devices storing alternate horizontal lines of a same frame of image data;

a second storage device writing circuit for sequentially writing thus-read image data for each pattern at addresses of a predetermined one of said two second storage devices so as to form an image data line defined by said ordered pattern of image data, said addresses corresponding to displaying dots of said image data;

a second storage device reading circuit for reading, according to the value of said horizontal direction counter, said image data line stored in a predetermined one of said two second storage devices;

a control circuit for controlling said second storage device writing circuit and said second storage device reading circuit so that an image data writing operation and an image data reading operation are preformed alternately between said two second storage devices for each horizontal scanning period;

at least one direction register storing at least one of X-direction and Y-direction sizes of said display image data measured from said defining starting positions of said plurality of patterns of image data, respectively; and an arrangement-starting-point register for storing values which indicate arrangement-starting-position from which said display image data of said plurality of patterns of image data are positioned in an imaginary coordinate plane, respectively, wherein said first storage device control circuit successively generates address and control signals for reading a respective line of said display image data from said first storage device, based on the values of said arrangement-starting-point register, the values of said offset register, the values of said vertical direction counter and values of said at least one direction register.

2. The image display control device according to claim 1, further comprising a priority order register for storing a value indicating a display priority order of said plurality of patterns of image data, wherein said first storage device control circuit controls, based on said display priority order, an order in which said display image data for each screen are read from said first storage device.

3. The image display control device, according to claim 1, wherein:

said first storage device has a RAM port and a serial port; and said first storage device control circuit performs a writing operation in response to instructions of a CPU to said RAM port of said first storage device and provides to said RAM port instructions for transferring image data from a RAM to said serial port, such that at least said display image data is output through said serial port.

4. The image display control device, according to claim 1, further comprising an image mode setting register for storing values indicating how a storage area of said first storage device is divided into image data storage areas for said plurality of patterns of image data, and for indicating how said image data storage areas are assigned for said plurality of patterns of image data, and wherein said first storage device control circuit generates address and control signals for said first storage device at least partially in response to values of said image mode setting register.

5. An image display control device, comprising:

a first storage device for storing a plurality of patterns of image data, each pattern defining a screen having display image data;

an offset register for storing values which define starting positions in said first storage device of the display image data for each screen;

a horizontal direction counter for counting dots in a horizontal scanning direction;

a vertical direction counter for counting lines in vertical scanning direction;

a first storage device control circuit for successively generating address and control signals for reading a respective line of said display image data from each screen from said first storage device within one horizontal scanning period, said address and control signals being based on values of said offset register and a value of said vertical direction counter;

two second storage devices, each selectively storing a thus-read respective line of said display image data for each screen in a predefined order such that image data of a previously stored pattern is overwritten at least by display image data of a subsequently stored pattern;

a second storage device writing circuit for sequentially writing thus-read image data for each pattern at addresses of a predetermined one of said two second storage devices so as to form an image data line defined by said ordered pattern of image data, said addresses corresponding to displaying dots of said image data;

a second storage device reading circuit for reading, according to the value of said horizontal direction counter, said image data line stored in a predetermined one of said two second storage devices;

a control circuit for controlling said second storage device writing circuit and said second storage device reading circuit so that an image data writing operation and an image data reading operation are preformed alternately between said two second storage devices for each horizontal scanning period;

an X-direction register for storing values which indicate X-direction sizes of said display image data for each screen measured from said starting positions of said display image data for each screen;

a Y-direction register for storing values which indicate Y-direction sizes of said display image data for each screen measured from said starting positions of said display image data for each screen; and an arrangement-starting-point register for storing values which indicate arrangement-starting-positions from which said display image data for each screen are positioned in an imaginary coordinate plane;

wherein said first storage device control circuit successively generates address and control signals for reading said respective line of said display image data from each screen based on values of said arrangement-starting-point register, values of said offset register, a value of said vertical direction counter and values of said Y-direction register.

6. A method for controlling an image display, comprising:

storing a plurality of patterns of image data, each pattern of image data defining a screen having display image data;

defining starting positions of the display image data for each screen, each starting position representing a memory address for the display image data;

successively generating address and control signals for reading a respective line of the display image data from each screen during one horizontal scanning period, said address and control signals being generated at least partially in response to the starting position of the display image data for each screen;

alternately storing a read line of display image data for each screen into one of two line storage devices such that image data of a previously stored pattern is overwritten at least by display image data of subsequently stored pattern to form display line image data, each of the two line storage devices storing alternate horizontal lines of a same frame of image data;

alternately reading the display line image data from the two line storage devices such that display line image data is read from one line store device while display line image data is written to the other line storage device;

storing at least one direction value comprising at least one of X-direction and Y-direction sizes of said display image data measured from said defining starting positions of said plurality of patterns of image data, respectively; and storing values which indicate arrangement-starting-position from which said display image data of said plurality of patterns of image data are positioned in an imaginary coordinate plane, respectively, wherein said step of successively generating address and control signals for reading a respective line of said display image data from said first storage device is based at least on the values of said arrangement-starting-position storing step, and the values of said defining starting position step and said at least one direction value.

* * * * *